US007799208B2

(12) United States Patent
Kokayeff et al.

(10) Patent No.: US 7,799,208 B2
(45) Date of Patent: Sep. 21, 2010

(54) HYDROCRACKING PROCESS

(75) Inventors: Peter Kokayeff, Des Plaines, IL (US); Bart Dziabala, Des Plaines, IL (US); Laura Elise Leonard, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 178 days.

(21) Appl. No.: 11/872,251

(22) Filed: Oct. 15, 2007

(65) Prior Publication Data

US 2009/0095655 A1 Apr. 16, 2009

(51) Int. Cl.
*C10G 65/02* (2006.01)

(52) U.S. Cl. ..... 208/59; 208/49; 208/89; 208/212

(58) Field of Classification Search ..... 208/49, 208/57, 59, 89, 212
See application file for complete search history.

(56) References Cited

U.S. PATENT DOCUMENTS

| | | | | |
|---|---|---|---|---|
| 3,130,006 | A | 4/1964 | Rabo et al. | 23/110 |
| 3,668,112 | A | 6/1972 | Parker et al. | 208/89 |
| 4,363,718 | A | 12/1982 | Klotz | 208/110 |
| 4,676,887 | A | 6/1987 | Fischer et al. | 208/61 |
| 4,738,766 | A | 4/1988 | Fischer et al. | 208/68 |
| 4,789,457 | A | 12/1988 | Fischer et al. | 208/68 |
| 4,828,677 | A | 5/1989 | Fischer et al. | 208/89 |
| 4,919,789 | A | 4/1990 | Fischer et al. | 208/61 |
| 4,943,366 | A | 7/1990 | Fischer et al. | 208/68 |
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 6,123,835 | A | 9/2000 | Ackerson et al. | 208/213 |
| 6,200,462 | B1 * | 3/2001 | Cash et al. | 208/89 |
| 6,217,746 | B1 * | 4/2001 | Thakkar et al. | 208/59 |
| 6,294,080 | B1 | 9/2001 | Thakkar et al. | 208/100 |
| 6,428,686 | B1 | 8/2002 | Ackerson et al. | 208/213 |
| 6,444,116 | B1 | 9/2002 | Galiasso et al. | 208/58 |
| 6,497,813 | B2 | 12/2002 | Ackerson et al. | 208/311 |
| 6,638,419 | B1 | 10/2003 | Da Silva et al. | 208/208 R |
| 6,689,273 | B1 | 2/2004 | Kalnes et al. | |

(Continued)

FOREIGN PATENT DOCUMENTS

EP 0 993 498 B1 8/2004

(Continued)

OTHER PUBLICATIONS

Gudde, N. J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

(Continued)

*Primary Examiner*—Walter D Griffin
*Assistant Examiner*—Renee Robinson
(74) *Attorney, Agent, or Firm*—James C Paschall

(57) ABSTRACT

Methods of hydrocracking hydrocarbon streams are provided that employ substantially liquid-phase continuous hydroprocessing conditions. In one aspect, the method includes a separate hydrotreating and hydrocracking system where the hydrocracking zone is a substantially liquid-phase continuous system. In another aspect, the method includes a two-stage hydrocracking system where one or both of the hydrocracking zones is a substantially liquid-phase continuous reaction system.

20 Claims, 5 Drawing Sheets

U.S. PATENT DOCUMENTS

| | | | | |
|---|---|---|---|---|
| 6,702,935 | B2 | 3/2004 | Cash et al. | |
| 6,881,326 | B2 | 4/2005 | Ackerson et al. | 208/213 |
| 6,890,425 | B2 | 5/2005 | Ackerson et al. | 208/311 |
| 7,078,439 | B2 | 7/2006 | Odueyungbo et al. | |
| 7,094,332 | B1 | 8/2006 | Kalnes et al. | 208/97 |
| 2005/0010076 | A1 | 1/2005 | Wasserscheid et al. | 585/862 |
| 2005/0082202 | A1 | 4/2005 | Ackerson et al. | 208/213 |
| 2006/0144756 | A1 | 7/2006 | Ackerson et al. | 208/108 |

FOREIGN PATENT DOCUMENTS

WO WO 00/34416 * 6/2000

OTHER PUBLICATIONS

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

U.S. Appl. No. 11/300,007, filed Dec. 14, 2005, Leonard.

U.S. Appl. No. 11/460,307, filed Jul. 27, 2006, Leonard.

U.S. Appl. No. 11/618,623, filed Dec. 29, 2006, Kokayeff.

U.S. Appl. No. 11/872,140, filed Oct. 15, 2007, Kokayeff.

U.S. Appl. No. 11/872,102, filed Oct. 15, 2007, Kokayeff.

U.S. Appl. No. 11/872,084, filed Oct. 15, 2007, Leonard.

U.S. Appl. No. 11/872,312, filed Oct. 15, 2007, Kokayeff.

U.S. Appl. No. 12/165,444, filed Jun. 30, 2008, Petri.

U.S. Appl. No. 12/165,499, filed Jun. 30, 2008, Kokayeff.

U.S. Appl. No. 12/165,522, filed Jun. 30, 2008, Kokayeff.

U.S. Appl. No. 12/495,574, filed Jun. 30, 2009, Petri.

U.S. Appl. No. 12/495,601, filed Jun. 30, 2009, Petri.

Office Action dated Jun. 4, 2009 in U.S. Appl. No. 11/460,307, Leonard.

Office Action dated Jun. 12, 2009 in U.S. Appl. No. 11/618,623, Kokayeff.

Office Action dated Oct. 5, 2009, Kokayeff, U.S. Appl. No. 11/872,312.

Applicants' Jan. 5, 2010 Response to the Oct. 5, 2009 Office Action, Kokayeff, U.S. Appl. No. 11/872,312.

* cited by examiner

HYDROCRACKING PROCESS

FIELD

The field generally relates to hydroprocessing of hydrocarbon streams and, more particularly, to catalytic hydrocracking systems.

BACKGROUND

Petroleum refiners often produce desirable products such as turbine fuel, diesel fuel, middle distillates, naphtha, and gasoline boiling hydrocarbons among others by hydrocracking a hydrocarbon feed stock derived from crude oil or heavy fractions thereof. Feed stocks subjected to hydrocracking can be vacuum gas oils, heavy gas oils, and other hydrocarbon streams recovered from crude oil by distillation. For example, a typical heavy gas oil comprises a substantial portion of hydrocarbon components boiling above about 371° C. (700° F.) and usually at least about 50 percent by weight boiling above 371° C. (700° F.), and a typical vacuum gas oil normally has a boiling point range between about 315° C. (600° F.) and about 565° C. (1050° F.).

Hydrocracking is a process that uses a hydrogen-containing gas with suitable catalyst(s) for a particular application. In general, there are three main configurations of hydrocracking units in use today: a single-stage hydrocracking system, a separate hydrotreat and hydrocracking system, and a two-stage hydrocracking system. In the single-stage hydrocracking system, the feed is first hydrotreated and then routed to a hydrocracking zone prior to a fractionation zone. In the separate hydrotreat and hydrocracking system, the feed is hydrotreated and then routed through the fractionation zone prior to the hydrocracker. In the two-stage hydrocracking system, the feed is hydrotreated, routed to a first hydrocracking zone, and then the effluent from the first hydrocracking zone is routed through the fractionation zone prior to a second hydrocracking zone.

Hydrocracking is currently accomplished by contacting the selected feed stock in a reaction vessel or zone with a suitable catalyst under conditions of elevated temperature and pressure in the presence of hydrogen as a separate phase in a three-phase reaction system (gas/liquid/solid catalyst). Such hydrocracking is commonly undertaken in a trickle-bed reactor where the continuous phase throughout the reactor is gas and not liquid.

In the trickle bed reactor, an excess of the hydrogen gas is present in the continuous gaseous phase. In many instances, a typical trickle-bed hydrocracking reactor requires up to about 10,000 SCF/B of hydrogen at pressures up to 17.3 MPa (2500 psig) to effect the desired reactions. In these systems, because the continuous phase throughout the reactor is a gas-phase, large amounts of hydrogen gas are generally required to maintain this continuous phase. However, supplying such large supplies of gaseous hydrogen at the operating conditions needed for hydrocracking adds complexity and expense to the system.

For example, in order to supply and maintain the needed amounts of hydrogen in a continuous gas-phase system, the resulting effluent from the cracking reactor is commonly separated into a gaseous component containing hydrogen and a liquid component. The gaseous component is directed to a compressor and then recycled back to the reactor inlet to help supply the large amounts of hydrogen gas needed to maintain the continuous gaseous phase therein. Conventional trickle-bed hydrocracking units typically operate up to about 17.3 MPa (2500 psig) and, therefore, require the use of a high-pressure recycle gas compressor in order to provide the recycled hydrogen at necessary elevated pressures. Often such hydrogen recycle can be up to about 10,000 SCF/B, and processing such quantities of hydrogen through a high-pressure compressor adds the complexity and cost to the hydrocracking unit.

Two-phase hydroprocessing (i.e., a liquid hydrocarbon stream and solid catalyst) has been proposed to convert certain hydrocarbon streams into more valuable hydrocarbon streams in some cases. For example, the reduction of sulfur in certain hydrocarbon streams may employ a two-phase reactor with pre-saturation of hydrogen rather than using a traditional three-phase system. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci., 59:2821-2829 (2004). These two-phase systems only use enough hydrogen to saturate the liquid-phase in the reactor. As a result, the reactor systems of Schmitz et al. have the shortcoming that as the reaction proceeds and hydrogen is consumed, the reaction rate decreases due to the depletion of the dissolved hydrogen.

Other uses of liquid-phase reactors to process certain hydrocarbonaceous streams require the use of diluent/solvent streams to aid in the solubility of hydrogen in the unconverted oil feed and require limits on the amount of hydrogen in the liquid feed streams. For example, liquid-phase hydrotreating of a diesel fuel has been proposed, but requires a recycle of hydrotreated diesel as a diluent blended into the oil feed prior to the liquid-phase reactor. In another example, liquid-phase hydrocracking of vacuum gas oil is proposed, but likewise requires the recycle of hydrocracked product into the feed to the liquid-phase hydrocracker as a diluent. These prior art systems also may permit the presence of some hydrogen gas in the liquid-phase reactors, but the systems are limited to about 10 percent or less hydrogen gas by total volume. Such limits on hydrogen gas in the system tend to restrict the overall reaction rates and the per-pass conversion rates in such liquid-phase reactors.

Because hydrotreating and hydrocracking typically require large amounts of hydrogen to effect their conversions, a large hydrogen demand is still required even if these reactions are completed in liquid-phase systems. As a result, to maintain such a liquid-phase hydrotreating or hydrocracking reaction and still provide the needed levels of hydrogen, the diluent or solvent of these prior liquid-phase systems is required in order to provide a larger relative concentration of dissolved hydrogen as compared to unconverted oil to insure adequate conversions can occur in the liquid-phase hydrotreating and hydrocracking zones. As such, larger and more complex liquid-phase systems are needed to achieve the desired conversions that still require large supplies of hydrogen.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

SUMMARY

In general, methods of hydrocracking hydrocarbonaceous streams are provided that employ one or more hydrocracking zones using substantially liquid-phase continuous hydroprocessing conditions. In one aspect, the selected hydrocarbonaceous feed stock is first directed to a hydrotreating zone, which can be a gas-phase continuous system, to produce a hydrotreating zone effluent. The hydrotreating zone effluent is then directed to a separation zone where one or more lower boiling point boiling hydrocarbon streams are separated from a higher boiling point liquid hydrocarbon stream. Hydrogen is then added to the higher boiling point liquid hydrocarbon stream or added to at least a portion thereof in an amount so that substantially liquid-phase conditions are maintained. The higher boiling point liquid hydrocarbon stream, which can be substantially undiluted with other hydrocarbon streams, is then directed to a substantially liquid-phase continuous hydrocracking zone where the stream is then reacted in the presence of a hydrocracking catalyst and under hydrocracking conditions to produce a hydrocracking zone effluent having hydrocarbons with a lower boiling point range relative to the higher boiling point liquid hydrocarbon stream fed to the hydrocracker. In another aspect, the higher boiling point liquid hydrocarbon stream or the at least a portion thereof directed to the substantially liquid-phase continuous hydrocracking zone is generally without a substantial hydrocarbon content provided by the liquid-phase hydrocracking zone or other recycle stream.

In another aspect, the selected hydrocarbonaceous feed stock is first directed to a hydrotreating zone, which preferably is a gas-phase continuous system, to produce a hydrotreating zone effluent. In this aspect, the hydrotreating zone effluent is then directed to a first hydrocracking zone (in one aspect, a gas-phase continuous zone and, in another aspect, a liquid-phase continuous zone) and contacted with a hydrocracking catalyst and operated under hydrocracking conditions to produce a first hydrocracking zone effluent. Next, the first hydrocracking zone effluent is separated into one or more lower boiling point hydrocarbon streams and a higher boiling point liquid hydrocarbon stream in a separation zone. An amount of hydrogen is added to the higher boiling point hydrocarbon stream or added to at least a portion thereof such that substantially liquid-phase conditions are maintained. The higher boiling point liquid hydrocarbon stream, which also can be substantially undiluted with other hydrocarbons, is then directed to a substantially liquid-phase continuous hydrocracking zone. Preferably, the higher boiling point liquid hydrocarbon stream is substantially undiluted with other hydrocarbon streams because sufficient hydrogen can be admixed with this feed stream to effect the desired cracking reactions in the hydrocracking zone without needing to dilute the reactive components. In the liquid-phase continuous hydrocracking zone, the higher boiling point liquid hydrocarbon stream is preferably reacted in the presence of a hydrocracking catalyst and under hydrocracking conditions to produce a second hydrocracking zone effluent having hydrocarbons with a lower boiling point range relative to the higher boiling point hydrocarbon stream fed to the second hydrocracker.

In such aspects, the one or more substantially liquid-phase continuous reaction zones reduce the hydrogen demand and eliminate the need for hydrogen circulation (compared to a conventional gas-phase continuous system) because the continuous phase is a liquid rather than a gas. The methods herein, therefore, can eliminate one or more costly, high pressure recycle gas compressors because the hydrogen demand can be supplied via a slip stream from a make-up hydrogen system. In another aspect, the methods described herein using one or more substantially liquid-phase continuous hydrocracking reaction zones can provide conversion levels of the selected feed stock to lower boiling point hydrocarbons equal to or greater than conversion levels obtained from conventional gas-phase continuous hydrocracking reaction zones; however, such conversion levels are obtained with a reduced hydrogen demand.

In each of the above aspects, an amount of hydrogen is added to the feed stream of the respective substantially liquid-phase continuous hydrocracking zones. In such aspect, the hydrogen is supplied in an amount and in a form available for substantially consistent consumption in the liquid-phase reaction zones. In such aspect, the hydrogen admixed with the feed to the respective liquid-phase hydrocracking zones is in an amount in excess of that required for saturation of the feed such that the hydrocracking reaction zones have a small vapor phase therein. In such aspect, the hydrogen can be supplied from a slip stream from a hydrogen make-up system, which generally avoids the use of high pressure compressors.

In this aspect, the liquid-phase streams have sufficient hydrogen therein such that the substantially liquid-phase reactors generally have a saturated level of hydrogen throughout the reactor as the reaction proceeds. In other words, as the reactions consume dissolved hydrogen, the liquid-phase has additional hydrogen that is continuously available from a small gas-phase entrained or otherwise associated with the liquid-phase to dissolve back into the liquid-phase to maintain the substantially constant level of saturation. Thus, in this aspect, the substantially liquid-phase reaction zones preferably have a generally constant level of dissolved hydrogen in the liquid streams from one end of the reactor zone to the other. As a result, such liquid-phase reactors may be operated at a substantially constant reaction rate to generally provide higher conversions per pass with smaller reactor vessels.

Other embodiments encompass further details of the process, such as preferred feed stocks, preferred hydrotreating catalysts, preferred liquid-phase catalysts, and preferred operating conditions to provide but a few examples. Such other embodiments and details are hereinafter disclosed in the following discussion of various aspects of the process.

DETAILED DESCRIPTION

Figure 1:
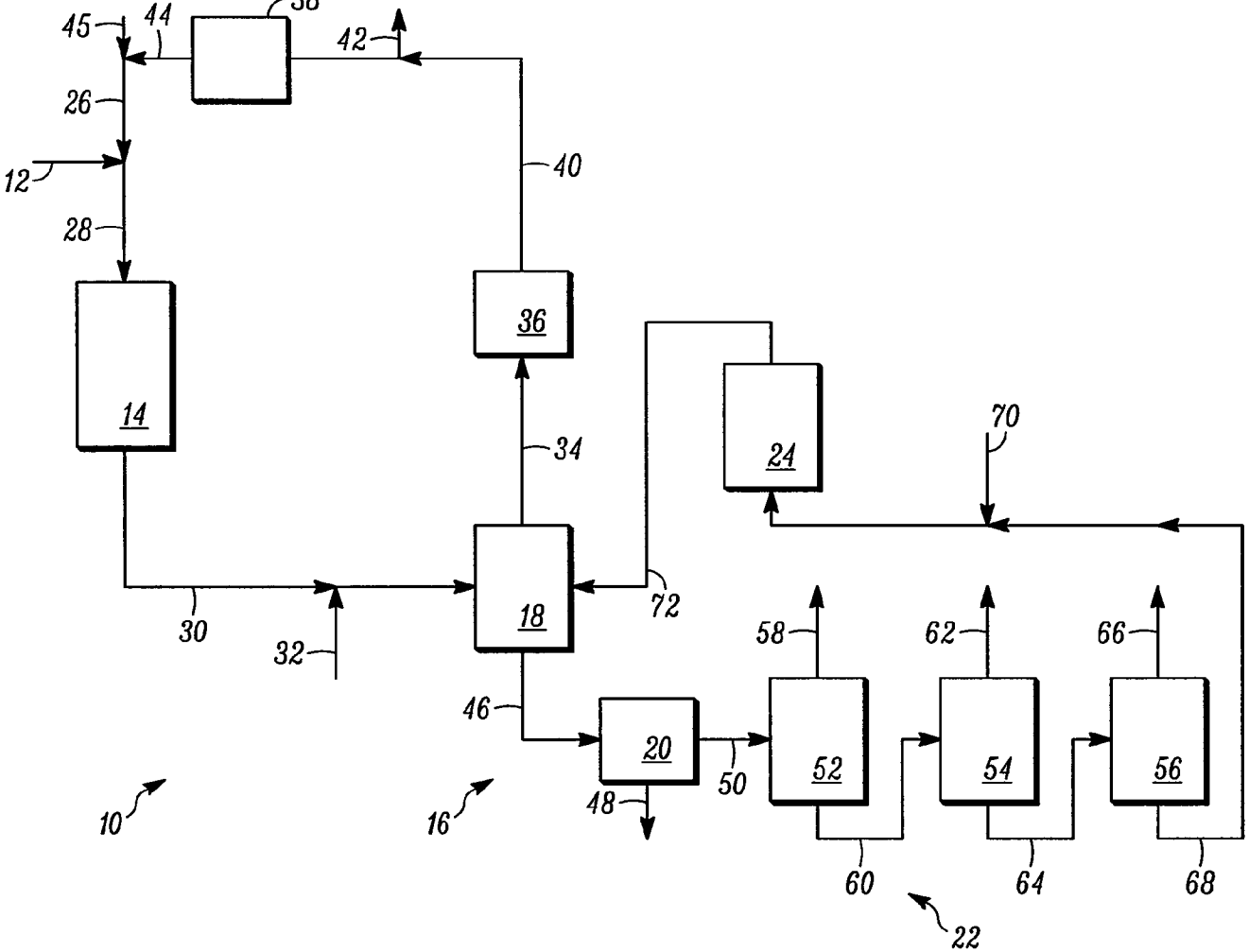
FIG. 1 is an exemplary flowchart of a hydrocracking process.

In one aspect, the processes described herein are particularly useful for hydrocracking a hydrocarbonaceous feed stock containing hydrocarbons and/or other organic materials to produce a product containing hydrocarbons and/or other organic materials of lower average boiling point and lower average molecular weight. Rather than using gas-phase continuous hydrocracking zones, which require large amounts of high pressure hydrogen and high pressure recycle gas compressors, the methods herein employ substantially liquid-phase continuous hydrocracking zones, which require reduced amounts of hydrogen that can be supplied via a slip stream from a hydrogen make-up system. Even with such reduced hydrogen levels, the methods herein can achieve a conversion level of at least about 40 percent and, preferably, a conversion level of at least about 97 percent. As used herein, conversion level refers to a comparison of the boiling point of the output streams to the boiling point of the feed stock and determining the total amount of output hydrocarbons having a boiling point range below a boiling point range of the feed stock.

In another aspect, the hydrocarbonaceous feed stocks that may be subjected to liquid-phase hydroprocessing by the methods disclosed herein include all mineral oils and synthetic oils (e.g., shale oil, tar sand products, etc.) and fractions thereof. Illustrative hydrocarbon feed stocks include those containing components boiling above 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. In one aspect, a preferred feed stock is a gas oil or other hydrocarbon fraction having at least about 50 weight percent, and preferably at least about 75 weight percent, of its components boiling at a temperature above about 371° C. (700° F.). For example, a preferred feed stock will contain hydrocarbon components which boil above about 288° C. (550° F.) with preferred results being achieved with feeds containing at least about 25 percent by volume of the components boiling between about 315° C. (600° F.) and about 565° C. (1050° F.).

In one aspect, the selected hydrocarbonaceous feed stock and a hydrogen-rich gaseous stream are admixed and introduced into a hydrotreating zone, which preferably is a gas-phase continuous hydrotreating zone, and reacted in the presence of hydrotreating catalysts and operated at hydrotreating conditions to produce a hydrotreating zone effluent having hydrogen sulfide and ammonia. Preferred hydrotreating reaction conditions include a temperature from about 360° C. (680° F.) to about 393° C. (740° F.), a pressure from about 11.03 MPa (1600 psig) to about 17.24 MPa (2500 psig), a liquid hourly space velocity of the fresh hydrocarbonaceous feed stock from about 0.5 $hr^{-1}$ to about 5 $hr^{-1}$ with a hydrotreating catalyst or a combination of hydrotreating catalysts.

In the hydrotreating zone, a hydrogen-containing treat gas (about 2,000 to about 8,000 SCF/B) is admixed with the hydrocarbonaceous feed stock and reacted in the presence of suitable catalyst(s) that are primarily active for the removal of heteroatoms, such as sulfur and nitrogen from the hydrocarbon feed stock. In one aspect, suitable hydrotreating catalysts for use in the present invention are conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

In this aspect, the effluent from the hydrotreating zone is then directed to a separation zone. The separation zone can include one or more of a high-pressure separation zone, a low-pressure separation zone, and/or a fractionation zone. In one aspect, the effluent from the hydrotreating zone is first contacted with an aqueous stream to dissolve any ammonium salts and then partially condensed. The hydrotreating effluent is then introduced into the high pressure vapor-liquid separator typically operating to produce a vaporous stream including light gases (i.e., hydrogen, methane, ethane, propane, hydrogen sulfide, ammonia, hydrocarbons boiling from about 32° C. (90° F.) to about 149° C. (300° F.) and the like) and a liquid hydrocarbon stream having a reduced concentration of sulfur and boiling in a range greater than the vaporous stream. By one approach, the high pressure separator operates at a temperature from about 32° C. (90° F.) to about 260° C. (500° F.) and a pressure from about 8.3 MPa (1200 psig) to about 17.2 MPa (2500 psig) to separate such streams. In yet another aspect, the vapor from the separator may be directed to an amine scrubber to remove contaminates, and then recycled back to the make-up hydrogen system and/or the hydrotreating reaction zone.

In another aspect, the liquid from the high pressure separation zone is then routed to a low pressure separation zone to remove sour water prior to additional fractionation. In such aspect, the low pressure separation zone operates at a temperature from about 32° C. (90° F.) to about 149° C. (300° F.) and a pressure from about 1 MPa (150 psig) to about 3.1 MPa (450 psig) to remove the sour water from the system. A liquid hydrocarbon effluent stream is removed from the low pressure separation zone and then routed to the fractionation zone.

In the fractionation zone, one or more lower boiling point hydrocarbon streams may be separated from a higher boiling point liquid hydrocarbon stream. In such aspect, the fractionation zone may be effective to separate light hydrocarbons boiling in the range from about 4° C. (40° F.) to about 93° C. (200° F.), naphtha boiling hydrocarbons boiling in the range from about 32° C. (90° F.) to about 260° C. (500° F.), and distillate boiling hydrocarbons boiling in the range from about 149° C. (300° F.) to about 385° C. (725° F.) from a liquid hydrocarbon stream boiling in the range from about 326° C. (650° F.) to about 593° C. (1100° F.). It will be appreciated, however, that other streams and boiling ranges may be formed from the fractionation zone depending on the feed composition, operating conditions, and other factors.

In one aspect, the fractionation zone may include a stabilizer fractionation zone, an atmospheric fractionation zone, and a vacuum fractionation zone. The stabilizer fractionation zone typically operates at a temperature from about 32° C. (90° F.) to about 66° C. (150° F.) and a pressure from about 0.07 MPa (10 psig) to about 7 MPa (100 psig) to separate out the light hydrocarbons (such as propane, butane, and the like) from hydrocarbons having a higher boiling point. The higher boiling hydrocarbons from the bottoms of the stabilizer fractionation zone are then routed to the atmospheric fractionation zone operating at a temperature from about 66° C. (150° F.) to about 288° C. (550° F.) and a pressure from about 0.7 MPa (10 psig) to about 7 MPa (100 psig) to separate out naphtha boiling hydrocarbons from remaining hydrocarbons having a higher boiling point. These remaining higher boiling hydrocarbons from the bottoms of the atmospheric fractionation zone are then routed to the vacuum fractionation zone operating at a temperature from about 204° C. (400° F.) to about 316° C. (600° F.) and a pressure from about 100 mm Hg vacuum to about 500 mm Hg vacuum to separate distillate products (such as kerosene, diesel, and the like) from the remaining hydrocarbons having a higher boiling point, which is the higher boiling point liquid hydrocarbon stream.

In yet another aspect, the higher boiling point liquid hydrocarbon stream (or at least a portion thereof) from the bottoms of the vacuum fractionation zone is taken as a hydroprocessing feed and then admixed with an amount of hydrogen and introduced into the substantially liquid-phase continuous hydrocracking zone. In such aspect, the added hydrogen is provided in an amount such that a substantially liquid-phase condition is maintained in the hydrocracking zone and such that a substantially constant reaction rate throughout the reactor is obtained. The higher boiling point hydrocarbon stream is then reacted in the substantially liquid-phase continuous hydrocracking zone with a hydrocracking catalyst and under hydrocracking conditions to produce a hydrocracking zone effluent having a lower boiling point range as compared to the higher boiling point hydrocarbon stream fed into the hydrocracking reactor.

In one aspect, the hydrocracking conditions include a temperature from about 315° C. (600° F.) to about 393° C. (740° F.), a pressure from about 11.03 MPa (1600 psig) to about 17.2 MPa (2500 psig) and a liquid hourly space velocity (LHSV) from about 0.5 $hr^{-1}$ to about 5 $hr^{-1}$. In some aspects, the hydrocracking reaction provides substantial conversion to lower boiling products, which may be a conversion of at least about 5 volume percent of the fresh feed stock to products having a lower boiling point. In other aspects, the per pass conversion in the hydrocracking zone is in the range from about 15 percent to about 75 percent and, preferably, the per-pass conversion is in the range from about 20 percent to about 60 percent. As a result, the ratio of unconverted hydrocarbons boiling in the range of the higher boiling point liquid hydrocarbon stream to the hydrocracking effluent is from about 1:5 to about 3:5. In one aspect, the processes herein are suitable for the production of naphtha, diesel or any other desired lower boiling hydrocarbons. Such conversion rates provide an overall conversion level for the process of at least about 40 percent and, in some aspects, at least about 97 percent.

Depending on the desired output, the hydrocracking zone may contain one or more beds of the same or different catalyst. In one aspect, when the preferred products are middle distillates, the preferred hydrocracking catalysts utilize amorphous bases or low-level zeolite bases combined with one or more Group VIII or Group VIB metal hydrogenating components. In another aspect, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. to about 648° C. (about 700° F. to about 1,200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between about 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates.

Crystalline chromosilicates are more fully described in U.S. Pat. No. 4,363,718 B1 (Klotz).

In one aspect, the amount of hydrogen admixed with the higher boiling point liquid hydrocarbon stream (or portion thereof) is an amount sufficient to saturate the stream with hydrogen. In another aspect, the amount of hydrogen added to the higher boiling point liquid hydrocarbon stream (or portion thereof) is in excess of that required to saturate the liquid such that the substantially liquid-phase hydrocracking zone also preferably has a small vapor phase. In such aspect, the additional amount of hydrogen in the higher boiling point liquid hydrocarbon stream is effective to maintain a substantially constant level of dissolved hydrogen in the liquid throughout the hydrocracking zone as the reaction proceeds. As a result, as the hydrocracking reaction proceeds and consumes the dissolved hydrogen, there is sufficient additional hydrogen in the small gas-phase to continuously provide additional hydrogen to dissolve back into the liquid-phase in order to provide a substantially constant level of dissolved hydrogen (such as generally provided by Henry's law, for example). The liquid-phase, therefore, remains substantially saturated with hydrogen even as the hydro-cracking reactions consume dissolved hydrogen. Such a substantially constant level of dissolved hydrogen is advantageous because it provides a generally constant hydrocracking reaction rate in the liquid-phase reactors.

In one aspect of the substantially liquid-phase hydrocracking reaction zone, the amount of hydrogen admixed with the feed thereof will generally range from an amount to saturate the stream to an amount (based on the operating conditions) where the stream is generally at a transition from a liquid to a gas phase, but still has a larger liquid phase than a gas phase. In one aspect, for example, the amount of hydrogen will range from about 125 percent to about 150 percent of saturation. In other aspects, it is expected that the amount of hydrogen may be up to about 500 percent of saturation and up to about 1000 percent of saturation. In some cases, the substantially liquid-phase hydrocracking reactors will have greater than about 10 percent and, in other cases, greater than about 25 percent hydrogen gas by volume in the hydrocracking reaction zone. In another aspect, at the liquid-phase hydrocracking conditions discussed above, it is expected that about 50 to about 250 SCF/B of added hydrogen will provide saturation; however, the amount of hydrogen will generally vary depending on the operating conditions, stream composition, desired output, and other factors. If needed, such additional amounts of hydrogen in excess of saturation can be added in order to maintain the substantially constant saturation of hydrogen throughout the liquid-phase reactor and enable the hydrocracking reactions.

In such aspect, the hydrogen will preferably comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous hydrocracking system may range from the vapor phase as small, discrete bubbles of gas finely dispersed in the continuous liquid-phase to a generally slug flow mode where the vapor phase separates into larger segments or slugs of gas traversing through the liquid. In either case, the liquid is the continuous phase throughout the reactors.

It should be appreciated, however, that the relative amount of hydrogen required to maintain such a substantially liquid-phase continuous hydrocracking system, and the preferred additional hydrogen thereof, is dependent upon the specific composition of the feed to this zone, the level or amount of hydrocracking desired, and/or the reaction zone temperature and pressure. The appropriate amount of hydrogen required will depend on the amount necessary to provide a liquid-phase continuous system, and the preferred additional hydrogen thereof, once all of the above-mentioned variables have been selected.

During the reactions occurring in the hydrocracking reaction zone, hydrogen is necessarily consumed. In some cases, the extra hydrogen admixed into the feed beyond that required for saturation can replace the consumed hydrogen to generally sustain the hydrocracking reaction. In other cases, additional hydrogen can also be added to the system through one or more hydrogen inlet points located in the reaction zones. With this option, the amount of hydrogen added at these locations is controlled to ensure that the system operates as a substantially liquid-phase continuous system. For example, the additional amount of hydrogen added using the hydrocracker reactor inlet points is generally an amount that maintains the saturated level of hydrogen and, in some cases, an additional amount in excess of saturation as described above.

In another aspect of the liquid-phase hydrocracking reactions, the feed to the substantially liquid-phase continuous hydrocracking zone (i.e., the higher boiling point liquid hydrocarbon stream from the bottoms of the vacuum fractionation zone) also operates without a hydrogen recycle, other hydrocarbon recycle streams, or admixing other hydrocarbon streams into the feed because sufficient hydrogen can be supplied into the substantially liquid-phase continuous hydrocracking reactor to at least initially effect the hydrocracking reactions without needing to dilute the feed. In one such aspect, the feed to the substantially liquid-phase continuous hydrocracking zone is generally without a substantial hydrocarbon content provided by a recycle or other liquid phase continuous hydroprocessing zone. Diluting or recycling streams into the feed of the liquid-phase continuous hydrocracking reaction zone would generally decrease the conversion per pass. As a result, the substantially undiluted feed provides for a less complex and smaller reactor systems to achieve the desired hydrocracking reactions.

The effluent from the substantially liquid-phase continuous hydrocracking zone is then routed to a separation zone, such as the same high-pressure separation zone that the effluent from the hydrotreating zone is separated within. Therefore, by sharing the separation zone, the cracked product from the hydrocracker is also processed through the fractionation zone to separate out one or more lighter products from any remaining heavier boiling hydrocarbons.

In alternative methods, a process is provided to hydrocrack a hydrocarbonaceous feed stock that employs a multi-stage hydrocracking zone where, in one aspect, the method has a first hydrocracking zone before the fractionation zone and a second hydrocracking zone after the fractionation zone. One or both of these hydrocracking zones may be operated under substantially liquid-phase continuous conditions similar to that previously described.

In one aspect of a multi-stage process, the effluent from the previously described hydrotreating zone may first be combined with a hydrogen containing treat gas and directed to a first hydrocracking zone, which may be a gas-phase continuous or a substantially liquid-phase continuous reaction zone. In this aspect, the hydrocracking zone reacts the hydrotreating zone effluent in the presence of hydrocracking catalysts (such as those described above) and at hydrocracking conditions to produce a first hydrocracking zone effluent having hydrocarbons with a lower average boiling point.

By one approach, the first hydrocracking zone of such a multi-stage hydrocracking method is conducted at hydrocracking reactor conditions which include a temperature from about 354° C. (670° F.) to about 393° C. (740° F.), a pressure from about 11.03 MPa (1600 psig) to about 17.2 MPa (2500 psig) and a liquid hourly space velocity (LHSV) from about 0.5 $hr^{-1}$ to about 5 $hr^{-1}$. In some aspects, this first hydrocracking reaction provides substantial conversion to lower boiling products, which may be the conversion of at least about 5 volume percent of the fresh feed stock to products having a lower boiling point than the feed to the second reaction zone. In other aspects, the per pass conversion in the first hydrocracking zone is in the range from about 15 percent to about 75 percent and, preferably, the per-pass conversion is in the range from about 20 percent to about 60 percent. As a result, the ratio of unconverted hydrocarbons boiling in the range of the hydrotreating effluent to the first hydrocracking effluent is from about 1:5 to about 3:5.

If the first hydrocracking zone of the multi-stage hydrocracking system is a substantially liquid-phase continuous reaction system, then the effluent from the hydro-treating zone may be first directed to a separator to remove any hydrogen and light gases (such as hydrogen sulfide, ammonia, and the like) from the hydrotreating effluent. The liquid effluent from the separator becomes the feed to the substantially liquid-phase first hydrocracking zone.

Similar to the previously described substantially liquid-phase continuous hydrocracking zone, in this aspect, the feed to the first hydrocracking zone (i.e., the separator liquid effluent) has an amount of hydrogen added therein such that substantially liquid-phase conditions are maintained. Preferably, in this option, hydrogen is added in excess of that required for saturation similar to the previously described liquid-phase hydrocracking reaction zone. Likewise, if a liquid-phase system is employed here, the feed to the first hydrocracking reaction zone is preferably undiluted with a diluent and/or other solvent, such as recycle streams, other hydrocarbon streams, and the like because sufficient hydrogen can be added to the liquid-phase system without the need to dilute the reactive components of the feed. The resultant effluent from the first hydrocracking reaction zone is directed to the separation zone and, preferably, to the high pressure separation zone as described above, where the higher boiling point liquid hydrocarbon stream is separated from other streams as previously described.

The higher boiling point liquid hydrocarbon stream from the fractionation zone is then directed to the second hydrocracking zone, which can be a gas-phase continuous or a substantially liquid-phase continuous system. If the second hydrocracking zone is a substantially liquid-phase continuous system, then this reaction zone will be configured similar to the previously described liquid-phase zones where, in one aspect, an amount of hydrogen is admixed into the higher boiling point liquid hydrocarbon stream; in another aspect, the amount of hydrogen is preferably in excess of that required to saturate the higher boiling point liquid hydrocarbon stream; and, in yet another aspect, the higher boiling point liquid hydrocarbon stream is substantially undiluted by other hydrocarbon streams. By one approach, the second hydrocracking zone operates at a temperature of about 315° C. (600° F.) to about 399° C. to about (750° F.) and pressures in the range of 11.03 MPa (1600 psig) to about 17.2 MPa (2500 psig) with a liquid hourly space velocity of about 0.5 $hr^{-1}$ to about 5 $hr^{-1}$. Other conditions also may be used depending on the desired output, feed compositions, and other factors. In such aspect, an effluent from this second hydrocracking zone is then routed to the high pressure separation zone so that the reacted components can be separated in the fractionation zone.

It should be appreciated that the exemplary conditions provided above for each of the various reaction zones and separation zones are only for illustration purposes and may vary depending on the feed stock composition, desired products to be produced, and other factors.

DETAILED DESCRIPTION OF THE DRAWING FIGURES

Turning to the figures, exemplary substantially liquid-phase hydrocracking systems will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to the FIG. 1, an integrated processing unit 10 is illustrated where a feed stream, which preferably comprises a vacuum gas oil, is introduced into the process 10 via line 12 and converted to one or more lower boiling hydrocarbonaceous streams using a hydrotreating zone 14, a separation zone 16 (which preferably includes a high-pressure separator 18, a low-pressure separator 20, and a fractionation zone 22) and a hydrocracking zone 24. In this aspect of the process, the hydrocracking zone 24 is a substantially liquid-phase continuous hydrocracking zone and is downstream of the separation zone 16.

In one aspect, the feed 12 is admixed with an amount of hydrogen supplied via line 26. The combined admixture is then directed via line 28 to the hydrotreating zone 14, which is preferably a gas-phase continuous system, where the feed 12 is reacted in the presence of one or more hydrotreating catalysts and at hydrotreating conditions to produce a hydrotreating effluent having hydrogen sulfide and ammonia.

The hydrotreating effluent is withdrawn from the hydrotreating zone 14 in line 30 and routed to the separation zone 16 and, preferably, to the high-pressure separator 18 to separate a gas stream from a liquid stream. Preferably, an aqueous stream is first added via line 32. A gas stream comprising hydrogen, hydrogen sulfide, ammonia and light hydrocarbons (such as methane, ethane, propane, hydrocarbons boiling from 32° C. (90° F.) to about 149° C. (300° F.), and the like) is removed from the high pressure separator 18 via line 34. The gas stream is then fed to an amine scrubber 36 to remove sulfur components and then to a recycle gas compressor 38 via line 40. A bleed line 42 may be used to prevent build-up of light gases in the recycle gas. Thereafter, a hydrogen rich stream 44 may be added back to the bulk hydrogen in line 26, which is eventually added to the inlet of the hydrotreating reaction zone 14. If needed, additional hydrogen may be provided from a make-up hydrogen system via line 45.

The liquid stream is removed from the high pressure separator 18 via line 46 and directed to the low-pressure separator 20 to remove sour water, which is removed from the system via line 48. The liquid hydrocarbons are then routed from the low pressure separator 20 via line 50 into the fractionation zone 22, which in this embodiment, includes a stabilizer fractionation zone 52, an atmospheric fractionation zone 54, and a vacuum fractionation zone 56. The liquid hydrocarbons in line 50 are first routed to the stabilizer zone 52 where a flash gas (such as propane, butane, and other light hydrocarbons) are separated via line 58 from higher boiling hydrocarbons that are removed from the bottoms of the stabilizer zone via line 60. The bottoms 60 from the stabilizer zone are then fed to the atmospheric fractionation zone 54 where naphtha boiling hydrocarbons are separated via line 62 from higher boiling hydrocarbons that are removed from the bottoms of the atmospheric zone via line 64. The bottoms 64 from the atmospheric zone 54 are then routed to the vacuum fractionation zone 56 where distillate products (such as kerosene, diesel, and the like) are separated via line 66 from a higher boiling point liquid hydrocarbon stream that is removed from the bottoms of the vacuum zone 56 via line 68.

The higher boiling liquid hydrocarbon stream 68 is then admixed with an amount of hydrogen provided via line 70, which is preferably supplied from a make-up hydrogen system, and this admixed stream is fed to the substantially liquid-phase hydrocracking zone 24. The effluent from the hydrocracking zone 24 is routed to the high pressure separator 18 via line 72.

Figure 2:
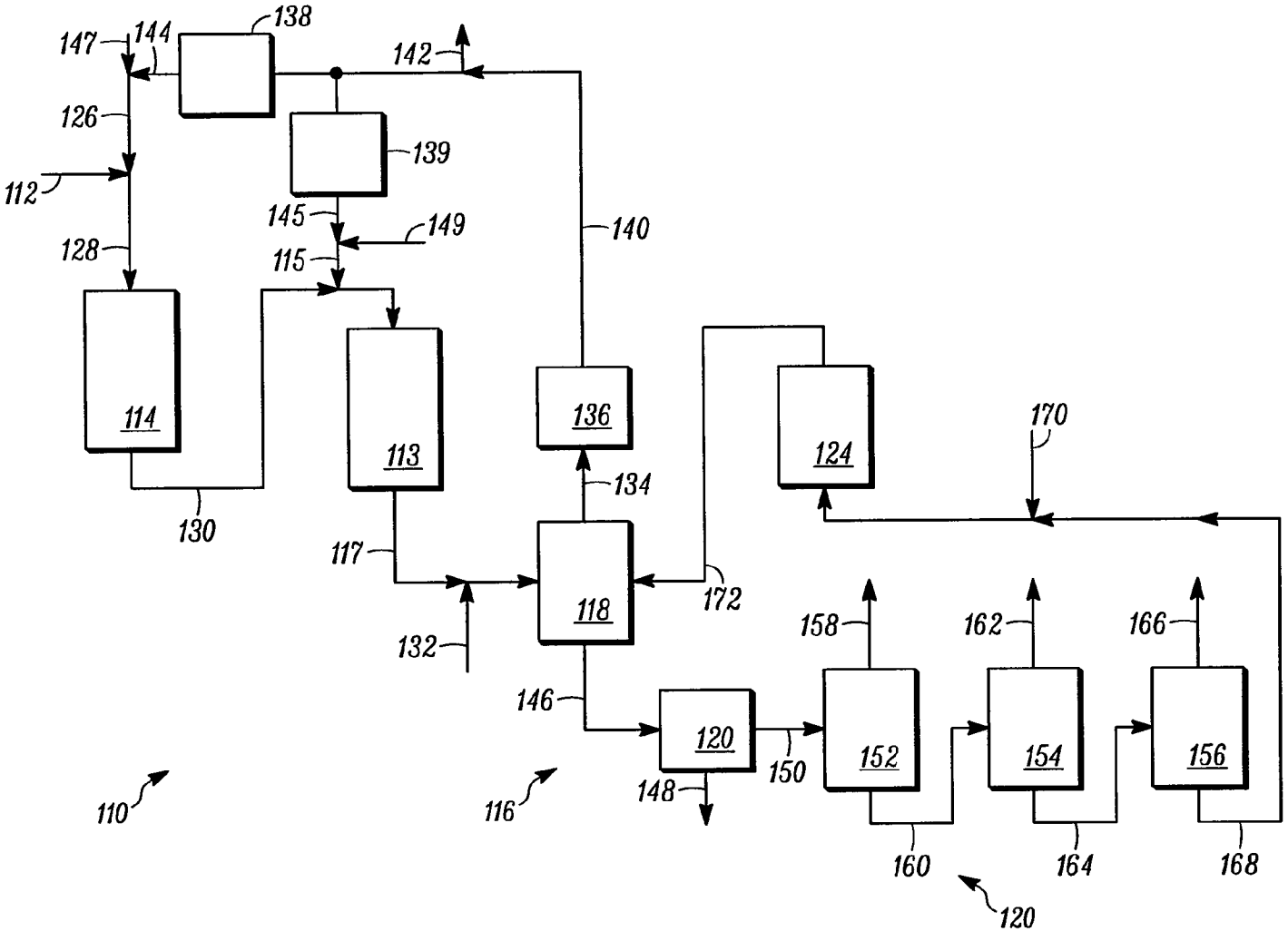
FIG. 2 is an exemplary flowchart of an alternative hydrocracking process.

Referring to FIG. 2, one embodiment of a multi-stage hydrocracking process 110 is illustrated. In this embodiment, one hydrocracking reaction zone is a gas-phase continuous system, and the other hydrocracking reaction zone is a substantially liquid-phase continuous system. Process 110 illustrates a feed stream, which preferably comprises a vacuum gas oil, introduced into the process 110 via line 112 and converted to one or more lower boiling hydrocarbonaceous streams using a hydrotreating zone 114, a first hydrocracking zone 113, a separation zone 116 (which preferably includes a high-pressure separator 118, a low-pressure separator 120, and a fractionation zone 122) and a second hydrocracking zone 124. In this aspect of the process, the first hydrocracking zone 113 is a gas-phase system and the second hydrocracking zone 124 is a substantially liquid-phase continuous hydrocracking zone.

In one aspect, the feed 112 is admixed with an amount of hydrogen supplied via line 126. The combined admixture is then directed via line 128 to the hydrotreating zone 114, which is preferably a gas-phase continuous system, where the feed 112 is reacted in the presence of one or more hydrotreating catalysts and at hydrotreating conditions to produce a hydrotreating effluent having hydrogen sulfide and ammonia.

The hydrotreating effluent is withdrawn from the hydrotreating zone 114 in line 130 and admixed with a gaseous rich hydrogen stream supplied by line 115 and then the admixed stream is routed to the first hydrocracking zone 113. The hydrocarbons in line 130 are then reacted in the first hydrocracking zone 113 in the presence of one or more hydrocracking catalyst under hydrocracking conditions to produce a first hydrocracking zone effluent.

The first hydrocracking zone effluent is removed from the hydrocracking zone 113 via line 117 and directed to the separation zone 116 and, preferably, to the high-pressure separator 118 to separate a gas stream from a liquid stream. Preferably, an aqueous stream is first added via line 132. A gas stream comprising hydrogen, hydrogen sulfide, ammonia and light hydrocarbons (such as methane, ethane, hydrocarbons boiling propane from 32° C. (90° F.) to about 149° C. (300° F.), and the like) is removed from the high pressure separator 118 via line 134. The gas stream is then fed to an amine scrubber 136 to remove sulfur components and then to two recycle gas compressors 138 and 139 via line 140. A bleed line 142 may be used to prevent build-up of light gases in the recycle gas. After compression, hydrogen rich gaseous streams 144 and 145 may be added back to the inlets of the hydro-treating reaction zone 114 and the hydrocracking reaction zone 113, respectively. If needed, additional hydrogen may be provided from a make-up hydrogen system via lines 147 and 149.

The liquid stream is removed from the high pressure separator 118 via line 146 and directed to the low-pressure separator 120 to remove sour water, which is removed from the system via line 148. The liquid hydrocarbons are then routed from the low pressure separator via line 150 into the fractionation zone 122, which in this embodiment, includes a stabilizer fractionation zone 152, an atmospheric fractionation zone 154, and a vacuum fractionation zone 156. The liquid hydrocarbons in line 150 are first routed to the stabilizer zone 152 where a flash gas (such as propane, butane, and other light hydrocarbons) are separated via line 158 from higher boiling hydrocarbons that are removed from the bottoms of the stabilizer zone via line 160. The bottoms 160 from the stabilizer zone 152 are then fed to the atmospheric fractionation zone 154 where naphtha boiling hydrocarbons are separated via line 162 from higher boiling hydrocarbons that are removed from the bottoms of the atmospheric zone via line 164. The bottoms 164 from the atmospheric zone 154 are then routed to the vacuum fractionation zone 156 where distillate products (such as kerosene, diesel, and the like) are separated via line 166 from a higher boiling liquid hydrocarbon stream that is removed from the bottoms of the vacuum zone 156 via line 168.

The higher boiling liquid hydrocarbon stream 168 is then admixed with an amount of hydrogen provided via line 170, which is preferably supplied from a make-up hydrogen system, and this admixed stream is fed to the substantially liquid-phase hydrocracking zone 124. The effluent from the hydrocracking zone 124 is routed to the high pressure separator 18 via line 172.

Figure 3:
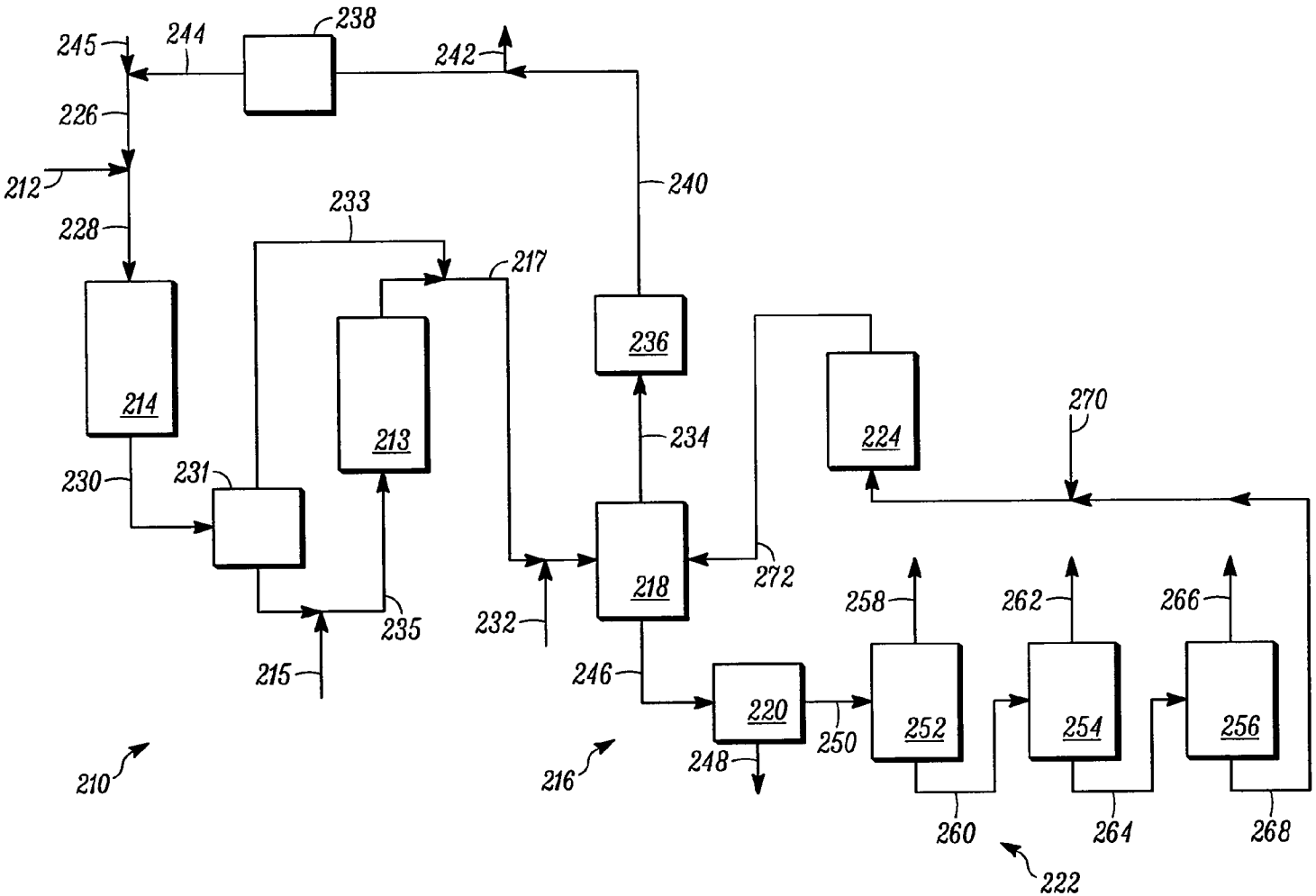
FIG. 3 is an exemplary flowchart of an alternative hydrocracking process.

Referring to FIG. 3, another embodiment of a multi-stage hydrocracking process 210 is illustrated. In this embodiment, both hydrocracking reaction zones operate under substantially liquid-phase conditions. Process 210 illustrates a feed stream, which preferably comprises a vacuum gas oil, introduced into the process 210 via line 212 and converted to one or more lower boiling hydrocarbonaceous streams using a hydrotreating zone 214, a first hydrocracking zone 213, a separation zone 216 (which preferably includes a high-pressure separator 218, a low-pressure separator 220, and a fractionation zone 222) and a second hydrocracking zone 224. In this aspect of the process, both the first hydrocracking zone 213 and the second hydrocracking zone 124 are operated under substantially liquid-phase continuous conditions.

In one aspect, the feed 212 is admixed with an amount of hydrogen supplied via line 226. The combined admixture is then directed via line 228 to the hydrotreating zone 214, which is preferably a gas-phase continuous system, where the feed 212 is reacted in the presence of one or more hydrotreating catalysts and at hydrotreating conditions to produce a hydrotreating effluent having hydrogen sulfide and ammonia.

The hydrotreating effluent is withdrawn from the hydrotreating zone 214 in line 230 and directed to a separation zone 231 to separate a vapor stream 233 from a liquid stream 235. The liquid stream 235 is admixed with an amount of hydrogen supplied by line 215 such that substantially liquid-phase conditions are maintained. The admixed stream is then routed to the first hydrocracking zone 213. The hydrocarbons in line 230 are then reacted in the first hydrocracking zone under substantially liquid-phase continuous conditions in the presence of one or more hydrocracking catalyst under hydrocracking conditions to produce a first hydrocracking zone effluent. The vapor stream 233 may be recombined with the first hydrocracking zone effluent if desired.

The first hydrocracking zone effluent is removed from the hydrocracking zone 213 via line 217 and directed to the separation zone 216 and, preferably, to the high-pressure separator 218 to separate a gas stream from a liquid stream. Preferably, an aqueous stream is first added via line 232. A gas stream comprising hydrogen, hydrogen sulfide, ammonia and hydrocarbons boiling in the range lower than the feed stock is removed from the high pressure separator 218 via line 234. The gas stream is then fed to an amine scrubber 236 to remove sulfur components and then to a recycle gas compressor 238 via line 240. A bleed line 242 may be used to prevent build-up of light gases in the recycle gas. After compression, a hydrogen rich gaseous stream 244 is added back to the inlet of only the hydrotreating reaction zone 214. If needed, additional hydrogen may be provided from a make-up hydrogen system via line 245.

The liquid stream is removed from the high pressure separator 218 via line 246 and directed to the low-pressure separator 220 to remove sour water, which is removed from the system via line 248. The liquid hydrocarbons are then routed from the low pressure separator via line 250 into the fractionation zone 222, which in this embodiment, includes a stabilizer fractionation zone 252, an atmospheric fractionation zone 254, and a vacuum fractionation zone 256. The liquid hydrocarbons in line 250 are first routed to the stabilizer zone 252 where a flash gas (such as propane, butane, and other light hydrocarbons) are separated via line 258 from higher boiling hydrocarbons that are removed from the bottoms of the stabilizer zone via line 260. The bottoms 260 from the stabilizer zone are then fed to the atmospheric fractionation zone 254 where naphtha boiling hydrocarbons are separated via line 262 from higher boiling hydrocarbons that are removed from the bottoms of the atmospheric zone via line 264. The bottoms 264 from the atmospheric zone 254 are then routed to the vacuum fractionation zone 256 where distillate products (such as kerosene, diesel, and the like) are separated via line 266 from a higher boiling liquid hydrocarbon stream that is removed from the bottoms of the vacuum zone 256 via line 268.

The higher boiling liquid hydrocarbon stream 268 is then admixed with an amount of hydrogen provided via line 270, which is preferably supplied from a make-up hydrogen system, and this admixed stream is fed to the substantially liquid-phase hydro-cracking zone 224. The effluent from the hydrocracking zone 224 is routed to the high pressure separator 218 via line 272.

The foregoing description of the drawing clearly illustrates the advantages encompassed by the processes described herein and the benefits to be afforded with the use thereof. In addition, the drawing figures are intended to illustrate exemplary flow schemes of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

In addition, advantages and embodiments of the methods described herein are further illustrated by the following Example. However, the particular conditions, flow schemes, materials, and amounts thereof recited in the Example, as well as other conditions and details, should not be construed to unduly limit the methods. All percentages are by weight unless otherwise indicated.

EXAMPLE

Figure 4:
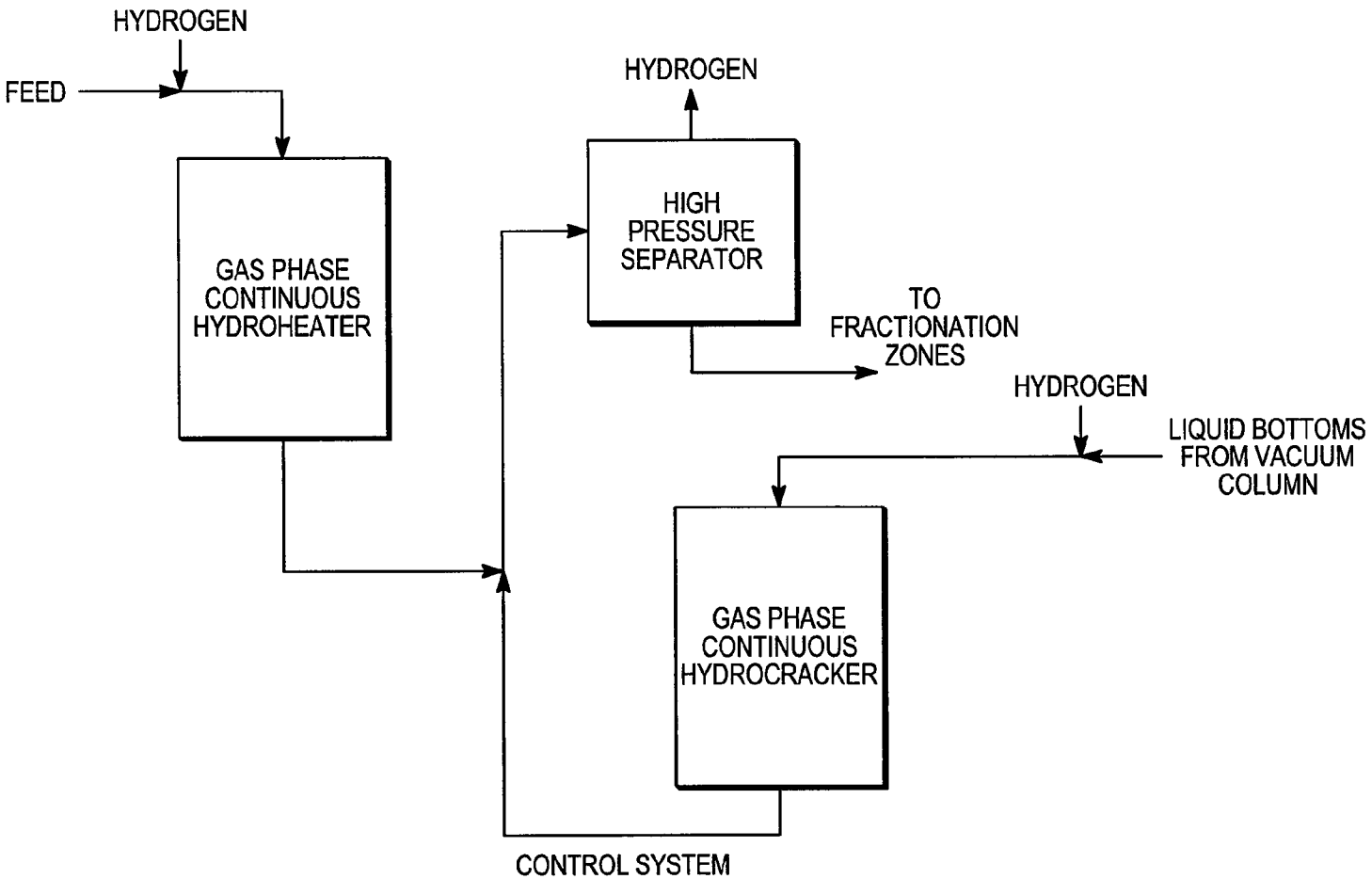
(PRIOR ART) FIG. 4
FIG. 4 is an exemplary flowchart of a conventional prior art gas-phase continuous separate hydrotreat and hydrocracking system from the Example.
Figure 5:
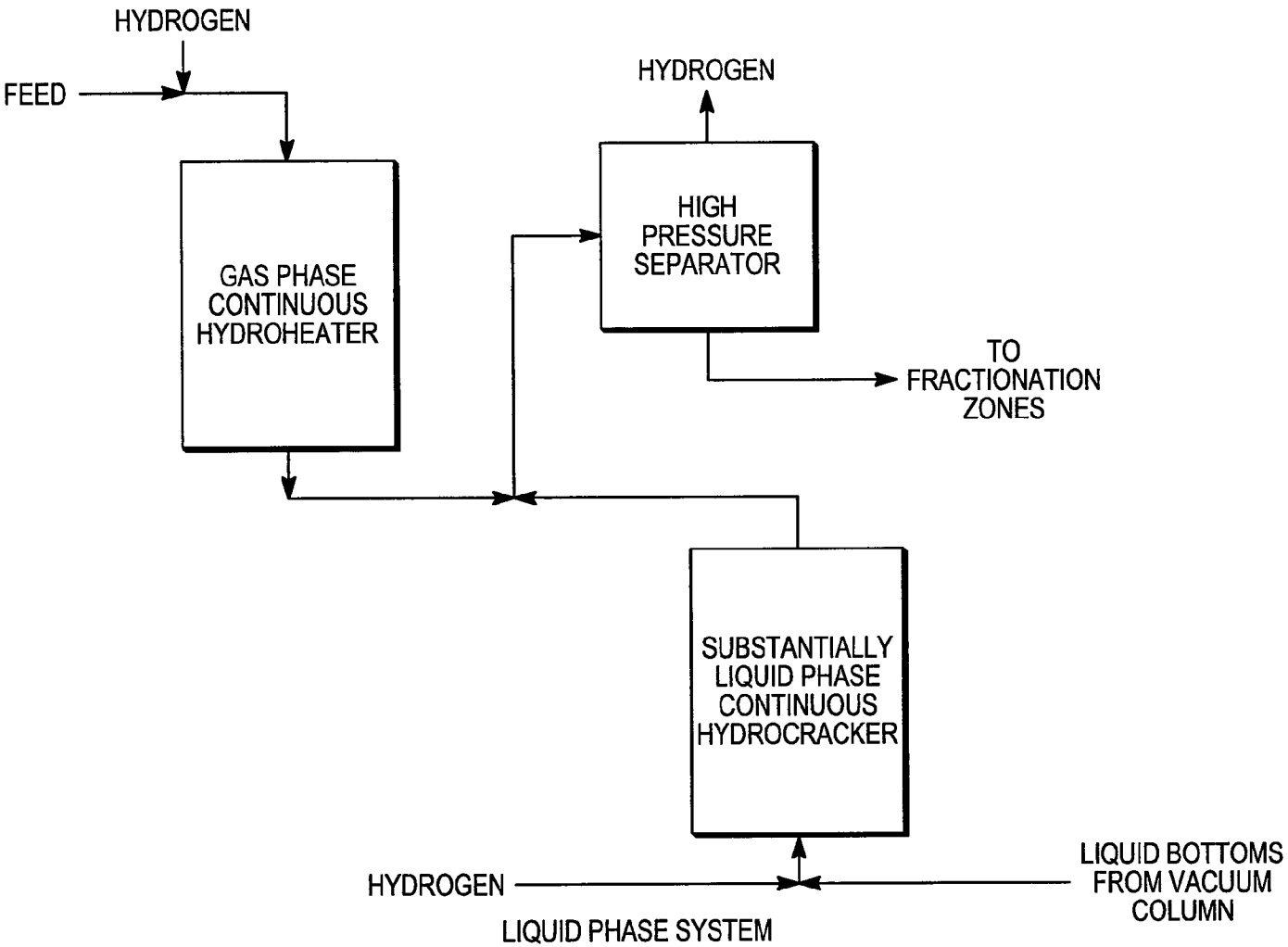
FIG. 5 is an exemplary flowchart of a separate hydrotreat and hydrocracking system from the Example using a substantially liquid-phase continuous hydrocracking reactor.

A separate hydrotreat and hydrocracking system using gas-phase continuous hydrotreating and hydrocracking reactors as generally illustrated in FIG. 4 (prior art system-control) was compared to a separate hydrotreat and hydrocracking system having a hydrocracking zone configured to operate in a substantially liquid-phase continuous mode (liquid-phase system) as illustrated in FIG. 5. A feed stock having the properties of Tables 1 and 2 was separately converted to lower boiling hydrocarbons in each system.

TABLE 1

| Feed Stock Properties | |
|---|---|
| Density (g/cc) | 0.9645 |
| Gravity, API | 15.20 |
| Sulfur (wt %) (XRF) | 3.40 |
| Nitrogen (wppm) (Chem) | 2341 |

TABLE 2

| Boiling Point Distribution (° F.) (ASTM D-2887) | |
|---|---|
| IBP/5 wt % | 425/579 |
| 10/20 | 628/684 |
| 30/40 | 726/762 |
| 50/60 | 794/825 |
| 70/80 | 857/895 |
| 90/95 | 943/981 |
| EBP | 1074 |

In each of the control system and liquid-phase system, the hydrotreating reactor was loaded with about 350 cc of a hydrotreating catalyst (nickel molybdenum on an alumina support), and the hydrocracking reactor was loaded with about 467 cc of a distillate hydrocracking catalyst (nickel tungsten with an alumina base including zeolite). Pressure was maintained at about 2100 psig in each system. The feed rate of the feedstock was adjusted to about 350 cc/hr to maintain a LHSV of 1 $hr^{-1}$ over the hydrotreating catalyst in the hydrotreating reactor. Temperature was adjusted in the hydrotreating reactor to target about 20 wppm nitrogen in the effluent exiting the hydrotreating reactor.

The effluent from the hydrotreating reactor was routed to a high pressure separator (HPS) and the liquid from the HPS was then routed to a fractionation section consisting of a stabilizer, atmospheric, and vacuum columns. The vacuum column was operated to deliver a liquid vacuum bottoms at a cut point of about 700° F. A feed rate of about 560 cc/hr of the liquid vacuum bottoms, corresponding to a LHSV of about 1.2 $hr^{-1}$, was routed to the hydrocracking reactor with the remainder taken as bleed. The temperature of the hydrocracking reactor was adjusted to effect the desired overall conversion of about 97 percent (i.e., a bleed rate of about 3 percent of the feed of feedstock or about 3 percent of 350 cc/hr).

The $H_2$/Oil ratio for the hydrotreating reactor in each system was maintained at about 4000 SCF/B. For the case of the hydrocracking reactor in the control system, the $H_2$/Oil was targeted at about 8000 SCF/B. For the liquid phase system, the $H_2$/Oil was reduced to about 1000 SCF/B (Case 1) and about 560 SCF/B (Case 2). Operating conditions and product yields from the fractionation zone (i.e., stabilizer, atmospheric, and vacuum columns) in each system are shown in Tables 3 and 4.

TABLE 3

| Operating Conditions | Control | Liquid Phase Case 1 | Liquid Phase Case 2 |
|---|---|---|---|
| Pressure (psig) | 2100 | 2100 | 2100 |
| Hydrotreating Temp (° F.) | 745 | 745 | 745 |
| Hydrocracking Temp (° F.) | 662 | 709 | 720 |
| Hydrotreating Hydrogen Feed Rate (SCF/B) | 4293 | 4327 | 3853 |
| Hydrocracking Hydrogen Feed Rate (SCF/B) | 7925 | 937 | 560 |
| Decrease in Hydrocracking Hydrogen relative to Control (%) | — | 88.2 | 92.9 |
| Hydrogen in excess required for saturation | — | 9x | 4.8x |
| Hydrotreating (LHSV) | 1.00 | 1.00 | 0.99 |
| Hydrocracking (LHSV) | 1.27 | 1.34 | 1.38 |
| Ratio of Feed to Hydrocracker to Feed to Hydrotreater | 1.70 | 1.79 | 1.86 |
| Nitrogen in Hydrotreating Effluent (wppm) | 14 | 18 | 20 |

TABLE 4

| Product Yields | Control | Liquid Phase Case 1 | Liquid Phase Case 2 |
|---|---|---|---|
| $H_2$ Consumption (SCF/B) | 2072 | 2074 | 2046 |
| $NH_3$ (%) | 0.28 | 0.28 | 0.28 |
| $H_2S$ (%) | 3.61 | 3.61 | 3.61 |
| C1 to C2 (%) | 0.40 | 0.50 | 0.53 |
| C3 to C4 (%) | 2.10 | 1.88 | 1.80 |
| C5 (%) | 2.30 | 1.23 | 1.68 |
| C6 (%) | 1.95 | 0.35 | 0.89 |
| C7 to 300° F. (%) | 12.54 | 11.92 | 11.24 |
| 300° F. to 500° F. (%) | 28.39 | 27.32 | 27.14 |
| 500° F. to 700° F. (%) | 48.68 | 53.17 | 53.03 |
| 300° F. to 700° F. Distillate (%) | 77.07 | 80.49 | 80.17 |
| 700° F. + (%) | 3.00 | 3.00 | 3.00 |
| Distillate Products (Vacuum Column Overhead) Properties | | | |
| API | 35.57 | 36.69 | 36.02 |
| IP-391 Aromatics | | | |
| 1-Ring (%) | 21.7 | 21.2 | 23.4 |
| 2-Ring (%) | 2.1 | 1.9 | 3.1 |
| Poly (%) | 0.1 | 0.2 | 0.3 |
| Liquid Bottoms from Vacuum Column (Recycle Feed to Hydrocracker) Properties | | | |
| API | 32.00 | 32.38 | 32.07 |

Both of the liquid-phase systems in Case 1 and Case 2 achieved conversion levels of the feed stock substantially the same as the gas-phase control, but required 88.2 percent and 92.9 percent less hydrogen, respectively, in the substantially liquid-phase hydrocracking reactors to achieve such results.

What is claimed is:

1. A method of hydrocracking a hydrocarbonaceous stream comprising:

providing a hydrocarbonaceous feed stock having a boiling point range;

directing the hydrocarbonaceous feed stock to a hydrotreating zone to produce a hydrotreating zone effluent;

directing the hydrotreating zone effluent to a separation zone to separate one or more lower boiling point hydrocarbon streams from a higher boiling point liquid hydrocarbon stream;

taking at least a portion of the higher boiling point liquid hydrocarbon stream as a hydroprocessing feed;

admixing an amount of hydrogen with the hydroprocessing feed such that substantially liquid-phase conditions are maintained;

directing the hydroprocessing feed to a substantially liquid-phase continuous hydrocracking zone; and reacting the hydroprocessing feed substantially undiluted with another hydrocarbon stream in the substantially liquid-phase continuous hydrocracking zone with a hydrocracking catalyst under hydrocracking conditions to produce a hydrocracking zone effluent having hydrocarbons with a lower boiling point range relative to the higher boiling point liquid hydrocarbon stream.

2. The method of claim 1, wherein the amount of hydrogen added to the hydroprocessing feed is in excess of that required for saturation of the hydroprocessing feed.

3. The method of claim 2, wherein the amount of hydrogen added to the hyroprocessing feed is up to about 1000 percent over that required for saturation of the hydroprocessing feed.

4. The method of claim 1, wherein the hydrogen added to the hydroprocessing feed is provided from a make-up hydrogen system.

5. The method of claim 1, wherein the substantially liquid-phase continuous hydrocracking zone operates without a recycle gas compressor.

6. The method of claim 1, wherein the hydrotreating zone is a gas-phase continuous reaction zone.

7. The method of claim 1, wherein the separation zone includes a high pressure separation zone upstream of a fractionation zone, and wherein the hydrotreating zone effluent is directed to the high pressure separation zone and the hydrocracking zone effluent is also directed to the high pressure separation zone.

8. The process of claim 7, wherein the fractionation zone separates light hydrocarbons boiling in the range from about 4° C. (40° F.) to about 93° C. (200° F.), naphtha boiling hydrocarbons boiling in the range from about 32° C. (90° F.) to about 260° C. (500° F.), distillate boiling hydrocarbons boiling in the range from about 149° C. (300° F.) to about 385° C. (725° F.), and the higher boiling point liquid hydrocarbon stream boiling in the range from about 326° C. (650° F.) to about 593° C. (1100° F.).

9. A method of hydrocracking a hydrocarbonaceous stream comprising:

providing a hydrocarbonaceous feed stock having a boiling point range;

directing the hydrocarbonaceous feed stock to a hydrotreating zone to produce a hydrotreating zone effluent;

directing at least a portion of the hydrotreating zone effluent to a first hydrocracking zone with a hydrocracking catalyst and operated under hydrocracking conditions to produce a first hydrocracking zone effluent;

separating the first hydrocracking zone effluent into one or more lower boiling point hydrocarbon streams and a higher boiling point liquid hydrocarbon stream in a separation zone;

taking at least a portion of the higher boiling point liquid hydrocarbon stream as a hydroprocessing feed;

adding an amount of hydrogen to the hydroprocessing feed such that substantially liquid-phase conditions are maintained;

directing the hydroprocessing feed to a substantially liquid-phase continuous hydrocracking zone; and reacting the hydroprocessing feed substantially undiluted with another hydrocarbon stream in the substantially liquid-phase continuous hydrocracking zone with a hydrocracking catalyst under hydrocracking conditions to produce a second hydrocracking zone effluent having hydrocarbons with a lower boiling point range relative to the higher boiling point hydrocarbon stream.

10. The method of claim 9, wherein the amount of hydrogen admixed with the hydroprocessing feed is in excess of that required for saturation of the hydroprocessing feed.

11. The process of claim 9, wherein the amount of hydrogen added to the hydroprocessing feed is up to about 1000 percent over that required for saturation of the hydroprocessing feed.

12. The process of claim 9, wherein the amount of hydrogen is provided from a make-up hydrogen system.

13. The method of claim 9, wherein the substantially liquid-phase continuous hydrocracking zone operates without a recycle gas compressor.

14. The method of claim 9, wherein the hydrotreating zone is a gas-phase continuous reaction zone.

15. The method of claim 9, wherein the first hydrocracking zone is a gas-phase continuous hydrocracking zone.

16. A method of hydrocracking a hydrocarbonaceous stream comprising:

providing a hydrocarbonaceous feed stock having a boiling point range;

directing the hydrocarbonaceous feed stock to a hydrotreating zone to produce a hydrotreating zone effluent having a gas-phase and a liquid-phase;

separating the gas-phase from the liquid-phase;

adding an amount of hydrogen to the liquid-phase such that substantially liquid-phase conditions are maintained;

directing the liquid-phase to a first substantially liquid-phase continuous hydrocracking zone, the liquid-phase substantially undiluted with another hydrocarbon stream, and the first substantially liquid-phase continuous hydrocracking zone operated under hydrocracking conditions to produce a first hydrocracking zone effluent;

separating the first hydrocracking zone effluent into one or more lower boiling point hydrocarbon streams and a higher boiling point liquid hydrocarbon stream in a separation zone;

adding an amount of hydrogen to the higher boiling point liquid hydrocarbon stream such that substantially liquid-phase conditions are maintained;

directing the higher boiling point hydrocarbon stream to a second substantially liquid-phase continuous hydrocracking zone, the higher boiling point hydrocarbon stream substantially undiluted with another hydrocarbon stream; and reacting the higher boiling point hydrocarbon stream in the second substantially liquid-phase continuous hydrocracking zone with a hydrocracking catalyst under hydrocracking conditions to produce a second hydrocracking zone effluent having hydrocarbons with a lower boiling point range relative to the higher boiling point hydrocarbon stream.

17. The method of claim 16, wherein the amount of hydrogen added to the hydrotreating zone effluent is up to about 1000 percent over that required for saturation of the hydrotreating zone effluent.

18. The method of claim 16, wherein the amount of hydrogen added to the hydrotreating zone effluent is provided from a make-up hydrogen system.

19. The method of claim 16, wherein the separation zone includes a high pressure separation zone upstream of a fractionation zone, and wherein the first hydrocracking zone effluent is first directed to the high pressure separation zone and the second hydrocracking zone effluent is also directed to the same high pressure separation zone.

20. The process of claim 19, wherein the fractionation zone separates light hydrocarbons boiling in the range from about 4° C. (40° F.) to about 93° C. (200° F.), naphtha boiling hydrocarbons boiling in the range from about 32° C. (90° F.) to about 260° C. (500° F.), distillate boiling hydrocarbons boiling in the range from about 149° C. (300° F.) to about 385° C. (725° F.), and the higher boiling point liquid hydrocarbon stream boiling in the range from about 326° C. (650° F.) to about 593° C. (1100° F.).

* * * * *